US009260984B2

(12) United States Patent
Bayrakdar

(10) Patent No.: US 9,260,984 B2
(45) Date of Patent: Feb. 16, 2016

(54) CAMSHAFT ADJUSTER

(71) Applicant: Schaeffler Technologies AG & Co. KG, Herzogenaurach (DE)

(72) Inventor: Ali Bayrakdar, Roethenbach/Pegnitz (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 14/422,169

(22) PCT Filed: May 17, 2013

(86) PCT No.: PCT/EP2013/060212

§ 371 (c)(1),
(2) Date: Feb. 17, 2015

(87) PCT Pub. No.: WO2014/029514

PCT Pub. Date: Feb. 27, 2014

(65) Prior Publication Data

US 2015/0226096 A1 Aug. 13, 2015

(30) Foreign Application Priority Data

Aug. 20, 2012 (DE) ..... 10 2012 214 757

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01)

(58) Field of Classification Search
CPC ..... F01L 1/344; F01L 1/3442
USPC ..... 123/90.15, 90.17
See application file for complete search history.

(56) References Cited

U.S. PATENT DOCUMENTS

| | | | | |
|---|---|---|---|---|
| 6,684,834 | B2 * | 2/2004 | Kohrs | F01L 1/022 123/90.15 |
| 7,246,580 | B2 | 7/2007 | Palesh et al. | |

FOREIGN PATENT DOCUMENTS

| | | |
|---|---|---|
| DE | 39 36 782 | 5/1991 |
| DE | 100 06 349 | 8/2001 |
| DE | 10 2009 029092 | 3/2011 |
| EP | 1 471 215 | 10/2004 |

* cited by examiner

*Primary Examiner* — Zelalem Eshete
(74) *Attorney, Agent, or Firm* — Davidson, Davidson & Kappel, LLC

(57) ABSTRACT

A camshaft adjuster (1) including a hub (2) for securing the camshaft adjuster (1) to one end (3) of a camshaft (4) is provided. The camshaft adjuster (1) includes a drive element (8) and an output element (9). An outer cover surface (5) of one section (6) of the hub (2), which faces the camshaft, is designed as a bevel surface (7) which protrudes from the camshaft adjuster (1) and can be brought into contact with a complementary bevel surface (24) of the end of the camshaft (3).

10 Claims, 2 Drawing Sheets

CAMSHAFT ADJUSTER

The present invention relates to a camshaft adjuster.

BACKGROUND

Camshaft adjusters are used in internal combustion engines to vary the control times of the combustion chamber valves to be able to vary the phase relation between a crankshaft and a camshaft in a defined angle range between a maximum advance position and a maximum retard position. Adjusting the control times to the instantaneous load and rotational speed reduces consumption and emissions. For this purpose, camshaft adjusters are integrated into a drive train via which a torque is transferred from the crankshaft to the camshaft. This drive train may be designed, for example, as a belt, chain or gear drive.

In a hydraulic camshaft adjuster, the output element and the driving element form one or multiple pair(s) of counteracting pressure chambers to which a hydraulic medium is applied. The driving element and the output element are coaxially situated. A relative movement between the driving element and the output element is created by filling and emptying individual pressure chambers. The rotatively acting spring between the driving element and the output element pushes the driving element toward the output element in an advantageous direction. This advantageous direction may be in the same direction or in the opposite direction of the direction of rotation.

One design of the hydraulic camshaft adjuster is the vane-type adjuster. Vane-type adjusters include a stator, a rotor and a drive wheel which has an external toothing. The rotor as the output element is usually designed to be rotatably fixedly connectable to the camshaft. The driving element includes the stator and the drive wheel. The stator and the drive wheel are rotatably fixedly connected to each other or, alternatively, they are designed to form a single piece with each other. The rotor is situated coaxially with respect to the stator and inside the stator. Together with their radially extending vanes, the rotor and the stator form oppositely acting oil chambers to which oil pressure may be applied and which facilitate a relative rotation between the stator and the rotor. The vanes are either designed to form a single piece with the rotor or the stator or are situated as "plugged-in vanes" in grooves of the rotor or stator provided for this purpose. The vane-type adjusters furthermore have various sealing covers. The stator and the sealing covers are secured to each other with the aid of multiple screw connections.

Another design of the hydraulic camshaft adjuster is the axial piston adjuster. In this case, a shifting element, which creates a relative rotation between a driving element and an output element via inclined toothings, is axially shifted with the aid of oil pressure.

A further design of a camshaft adjuster is the electromechanical camshaft adjuster, which has a three-shaft gear set (for example, a planetary gear set). One of the shafts forms the driving element and a second shaft forms the output element. Rotation energy may be supplied to the system or removed from the system via the third shaft with the aid of an actuating device, for example an electric motor or a brake. A spring may be additionally situated, which supports or feeds back the relative rotation between the driving element and the output element.

The camshaft adjuster or the output element of the camshaft adjuster is rotationally fixedly fastened to the camshaft with the aid of a screw, which is coaxial to the camshaft, or a nut in such a way that a rotation of the output element is transmittable to the camshaft.

SUMMARY OF THE INVENTION

It is an object of the present invention to provide a camshaft adjuster which permits a space-saving and centering attachment of the camshaft adjuster to the camshaft.

The present invention provides a camshaft adjuster having a hub for attaching the camshaft adjuster to a camshaft end of a camshaft, the camshaft adjuster having a driving element and an output element, achieves the object according to the present invention in that an outer lateral surface of a camshaft-facing section of the hub is designed as a conical surface, this conical surface projecting out of the camshaft adjuster and being engageable with a complementary conical surface of the camshaft end.

A fastening device for connecting the camshaft adjuster to the camshaft thus includes the camshaft adjuster-side camshaft end of the camshaft and the hub of the camshaft adjuster, the outer lateral surface of the camshaft-facing section of the hub being designed as a conical surface, this conical surface projecting out of the camshaft adjuster in the axial direction and engaging with the complementary conical surface of the camshaft end. The hub of the camshaft adjuster is also surrounded by the camshaft end, so that both conical surfaces contact each other.

The hub of the camshaft adjuster is rotatably fixedly connected to the output element. The hub may be designed as a single piece or separately from the output element. The hub, in particular its conical surface, advantageously projects beyond a front-side delimiting plane of the camshaft adjuster to be able to be surrounded by the camshaft end.

The camshaft adjuster-side camshaft end of the camshaft is the end piece of the camshaft to which the camshaft adjuster will be or is attached. The end piece may be designed to form a single piece with the camshaft or to be separate from the camshaft.

Due to the camshaft adjuster according to the present invention, a space-saving and reliable attachment of the camshaft adjuster to the camshaft on the camshaft-facing side of the camshaft adjuster is facilitated.

In one embodiment of the present invention, the conical surface of the hub tapers in the axial direction toward the camshaft. The axial direction in this case is oriented along the rotation axis of the camshaft adjuster or the camshaft. Due to the tapering, the camshaft adjuster may be easily mounted on the camshaft, a centering being simultaneously provided by the conical surface pairing. A permanent securing of the conical surface pairing may take place or have taken place with the aid of an integral fit, such as welding, gluing, soldering, etc.

Another embodiment of the present invention provides that the hub is designed as a separate component from the output element. The hub is advantageously designed as a tube or a sleeve. It may be thermally treated differently from the output element and/or be made of a different material than the output element. The rotatably fixed connection between the output element and the hub is provided by a force fit, form fit and/or integral fit.

In one advantageous embodiment of the present invention, the hub is designed as a sheet metal sleeve. The sheet metal sleeve may either have a central through-opening or be provided with a base. The conical surface of the sheet metal sleeve may advantageously be provided by forming, whereby the material in the area of the conical surface is compressed, and an improved surface quality is achieved, preferably without subsequent machining steps.

In one embodiment of the present invention, the hub has a contact surface for a fastening nut or a fastening screw. This contact surface may be provided by a shoulder, a collar or a front-side delimiting surface of the hub. This contact surface is advantageously provided by the hub on the side of the camshaft adjuster facing the camshaft.

In another embodiment of the present invention, the camshaft adjuster includes a fastening nut, both the contact surface and the fastening nut itself being provided on the side of the camshaft adjuster facing the camshaft. The installation space on the side of the camshaft adjuster facing the camshaft is advantageously reduced thereby. The camshaft adjuster may be supplied as a structural unit with the fastening nut, which is captively situated between the contact surface and the camshaft adjuster, due to the axial delimitation on both sides.

In another embodiment of the present invention, the camshaft adjuster includes a fastening screw, both the contact surface and the fastening screw itself being provided on the side of the camshaft adjuster facing the camshaft. The fastening screw advantageously does not fully penetrate the hub of the camshaft adjuster in the axial direction, so that the screw head of the fastening screw is also situated on the side of the camshaft adjuster facing the camshaft. Axially adjacent to the screw head and radially surrounded by the output element of the camshaft adjuster, the installation space inside the hub may be used for a central valve. Radial installation space is advantageously saved, since the fastening screw no longer surrounds the central valve. It is furthermore advantageous that the axial installation space on the side of the camshaft adjuster facing away from the camshaft is no longer blocked by the screw head. The sequence of the arrangement in the axial direction, starting from the side of the camshaft adjuster facing away from the camshaft, may begin with the central valve, followed by the fastening screw in the axial direction of the camshaft, which is finally embedded in the camshaft end of the camshaft to the greatest possible extent.

In one advantageous embodiment of the present invention, the fastening screw is situated inside the hub, only the thread of the fastening screw projecting out of the hub. Here, the contact surface for the fastening screw is situated in the axial area of the output element, the fastening screw not projecting out of the side of the camshaft adjuster facing away from the camshaft in the axial direction but being embedded within the hub. A fastening screw of this type may advantageously have a longer screw shaft, which has the necessary elongation length with regard to the required pretensioning force.

In another embodiment of the present invention, a fastening device for connecting the camshaft adjuster to the camshaft includes the camshaft adjuster-side camshaft end of the camshaft and the hub of the camshaft adjuster, the outer lateral surface of the camshaft-facing section of the hub being designed as a conical surface, this conical surface projecting out of the camshaft adjuster in the axial direction and engaging with the complementary conical surface of the camshaft end. The hub of the camshaft adjuster is also surrounded by the camshaft end, so that both conical surfaces contact each other.

In one favored embodiment of the fastening device, the camshaft has an external thread, which is in engagement with the fastening nut and which clamps the camshaft adjuster or its hub with the camshaft end.

BRIEF DESCRIPTION OF THE DRAWINGS

Exemplary embodiments of the present invention are illustrated in the figures.

DETAILED DESCRIPTION OF THE INVENTION

Figure 1:
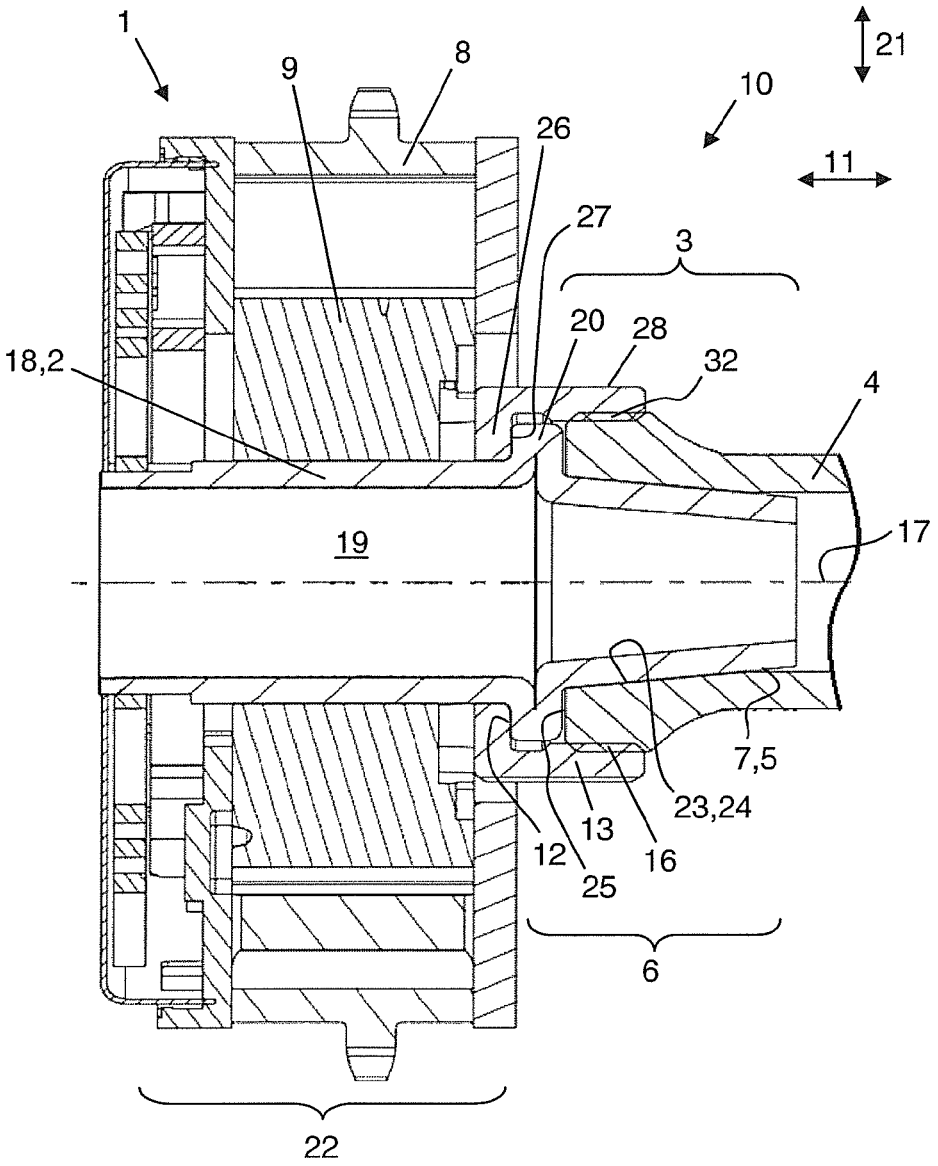
FIG. 1 shows a fastening device according to the present invention, including a fastening nut.

FIG. 1 shows a fastening device 10 according to the present invention, including a fastening nut 13.

Fastening device 10 includes a camshaft adjuster 1, a camshaft adjuster-side camshaft end 3 of a camshaft 4, a fastening nut 13 and a hub 2 of camshaft adjuster 1. All aforementioned components are situated coaxially to each other and to rotation axis 17 of fastening device 10.

Camshaft adjuster 1 has a driving element 8, an output element 9 and a hub 2. Hub 2 is rotatably fixedly connected to output element 9 and is designed as tube 18. Tube 18 has a largely uniform wall thickness as well as a central through-opening 19, which is situated coaxially to rotation axis 17. Section 6 of hub 2 projects out of camshaft adjuster 1 and has a conical surface 7 on its outer lateral surface 5. Conical surface 7 tapers in axial direction 11 toward camshaft 4. Hub 2 furthermore has a contact surface 12, which is provided by a folded collar 20. Folded collar 20 extends in radial direction 21 and is adjacent to section 6 with conical surface 7. Contact surface 12 is oriented toward output element 9 of camshaft adjuster 1 and is designed to have a circular ring shape. Collar 20 abuts a cylindrical section 22 in axial direction 11, which accommodates output element 9 and, in this exemplary embodiment, penetrates output element 9. Through-opening 19 may accommodate a central valve in the area of cylindrical section 22.

Camshaft end 3 of camshaft 4 has a conical surface 24 on its inner lateral surface 23, which is widened in axial direction 11 of its camshaft adjuster-facing front side 25. The cone angle of conical surface 24 is designed to be complementary to the cone angle of conical surface 7 and ideally has approximately the same size. Camshaft end 3 furthermore has an external thread 16 for fastening nut 13.

Fastening nut 13 of fastening device 10 rotatably fixedly clamps hub 2 to camshaft end 3. For this purpose, fastening nut 13 with its internal thread 32 is in engagement with external thread 16 of camshaft end 3. In addition, fastening nut 13 includes a collar 26, which is directed radially to the inside and which contacts contact surface 12 of hub 2 with its camshaft-facing front side 27, ideally over a wide area. A mounting tool may engage with outer lateral surface 28 of fastening nut 13, which may be designed, for example, as a hexagon, and screw fastening nut 13 to camshaft 4. Collar 20 is clamped thereby in axial direction 11 of camshaft 4, conical surface pairs 7, 24 being pressed against each other. Due to a remaining gap between front side 25 and collar 20 and due to the folded design of collar 20 from a hub 2 as tube 18, this screw connection has sufficient flexibility, which reliably counteracts the setting behavior of the screw connection over the service life. Sufficient pretensioning force is also provided for the rotatably fixed connection between hub 2 and camshaft 4 to be reliably maintained over the service life.

Figure 2:
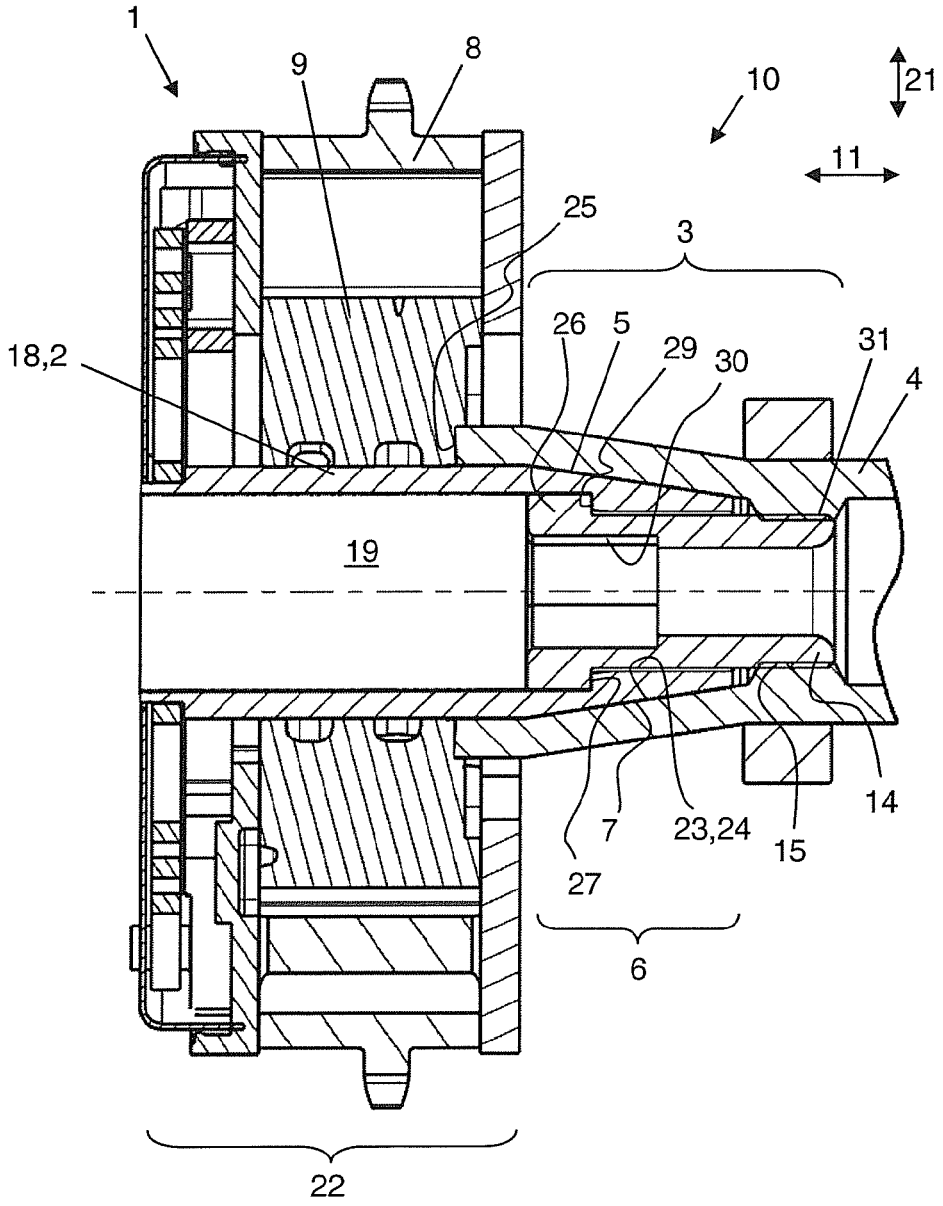
FIG. 2 shows a fastening device according to the present invention, including a fastening screw.

FIG. 2 shows a fastening device 10 according to the present invention, including a fastening screw 14.

Fastening device 10 includes a camshaft adjuster 1, a camshaft adjuster-side camshaft end 3 of a camshaft 4, a fastening screw 14 and a hub 2 of camshaft adjuster 1. All aforementioned components are situated coaxially to each other and to rotation axis 17 of fastening device 10.

Camshaft adjuster 1 has a driving element 8, an output element 9 and a hub 2. Hub 2 is rotatably fixedly connected to output element 9 and designed as tube 18. Tube 18 has a largely uniform wall thickness as well as a central through-opening 19, which is situated coaxially to rotation axis 17. Section 6 of hub 2 projects out of camshaft adjuster 1 and has a conical surface 7 on its outer lateral surface 5. Conical surface 7 tapers in axial direction 11 toward camshaft 4. Through-opening 19 of hub 2 furthermore has a shoulder 29 which includes a contact surface 12, which is provided for contacting with a front side 27 of fastening screw 14. Shoulder 29 is situated in the area of conical surface 7 in axial direction 11. Contact surface 12 is oriented toward output element 9 of camshaft adjuster 1 and is designed to have a circular ring shape. Tube 18 furthermore has a cylindrical section 22 adjacent to shoulder 29, which accommodates output element 9 and, in this exemplary embodiment, penetrates output element 9. Through-opening 19 may accommodate a central valve in the area of cylindrical section 22.

Camshaft end 3 of camshaft 4 has a conical surface 24 on its inner lateral surface 23, which is widened in axial direction 11 of its camshaft adjuster-facing front side 25. The cone angle of conical surface 24 is designed to be complementary to the cone angle of conical surface 7 and ideally have approximately the same size. Camshaft end 3 furthermore has an internal thread 31 for fastening screw 14. Front side 25 may be in contact with output element 9.

Fastening screw 14 of fastening device 10 rotatably fixedly clamps hub 2 to camshaft end 3. For this purpose, fastening screw 14 is in engagement with internal thread 31 of camshaft end 3. In addition, fastening screw 14 includes a collar 26, which is directed radially to the outside and which contacts contact surface 12 of shoulder 9 of hub 2 with its camshaft-facing front side 27, ideally over a wide area. Collar 26 of fastening screw 14 is part of its screw head. A mounting tool may engage with inner lateral surface 30 of fastening screw 14, which may be designed, for example, as a hexagon, and screw fastening screw 14 to camshaft 4. Fastening screw 14 is elongated thereby in axial direction 11 toward camshaft 4, conical surface pairs 7, 24 being pressed against each other. Due to the axial length of fastening screw 14, this screw connection has a sufficient flexibility, which reliably counteracts the setting behavior of the screw connection over the service life. Sufficient pretensioning force is also provided for the rotatably fixed connection between hub 2 and camshaft 4 to be reliably maintained over the service life.

LIST OF REFERENCE NUMERALS

1) Camshaft adjuster
2) Hub
3) Camshaft end
4) Camshaft
5) Outer lateral surface
6) Section
7) Conical surface
8) Driving element
9) Output element
10) Fastening device
11) Axial direction
12) Contact surface
13) Fastening nut
14) Fastening screw
15) Thread
16) External thread
17) Rotation axis
18) Tube
19) Through-opening
20) Collar
21) Radial direction
22) Cylindrical section
23) Inner lateral surface
24) Conical surface
25) Front side
26) Collar
27) Front side
28) Outer lateral surface
29) Shoulder
30) Inner lateral surface
31) Internal thread
32) Internal thread

What is claimed is:

1. A camshaft adjuster comprising:

a hub for fastening the camshaft adjuster to a camshaft end of a camshaft;

a driving element; and an output element, an outer lateral surface of a camshaft-facing section of the hub being designed as a conical surface projecting out of the camshaft adjuster and being engageable with a complementary conical surface of the camshaft end.

2. The camshaft adjuster as recited in claim 1 wherein the conical surface of the hub tapers in an axial direction toward the camshaft.

3. The camshaft adjuster as recited in claim 1 wherein the hub is designed as a separate component from the output element.

4. The camshaft adjuster as recited in claim 1 wherein the hub is designed as a sheet metal sleeve.

5. The camshaft adjuster as recited in claim 1 wherein the hub has a contact surface for a fastening nut or a fastening screw.

6. The camshaft adjuster as recited in claim 5 wherein the camshaft adjuster has a fastening nut and both the contact surface and the fastening nut are situated on the camshaft-facing side of the camshaft adjuster.

7. The camshaft adjuster as recited in claim 5 wherein the camshaft adjuster has a fastening screw, and both the contact surface and the fastening screw are situated on the camshaft-facing section of the camshaft adjuster.

8. The camshaft adjuster as recited in claim 1 wherein hub has a contact surface for a fastening screw and the fastening screw is situated inside the hub, and only the thread of the fastening screw projects out of the hub.

9. A fastening device comprising:

the camshaft end and the camshaft adjuster as recited in claim 1, the hub of the camshaft adjuster being surrounded by the camshaft end.

10. The fastening device as recited in claim 9 wherein the camshaft has an external thread in engagement with a fastening nut and clamps the camshaft adjuster or the hub to the camshaft end.

* * * * *